United States Patent [19]

Amici et al.

[11] Patent Number: 4,610,640

[45] Date of Patent: Sep. 9, 1986

[54] GLOVE PUPPET FIGURE ASSEMBLY WITH ARTICULATED HEAD COMPONENTS

[75] Inventors: Francis R. Amici, Northford; Hans S. Berger, Plainville; Domenic G. Mercurio, Elmwood; John P. McNett, Farmington; Pietro Piazza, Prospect, all of Conn.

[73] Assignee: Coleco Industries, Inc., West Hartford, Conn.

[21] Appl. No.: 703,732

[22] Filed: Feb. 21, 1985

[51] Int. Cl.[4] ..... A63H 3/14

[52] U.S. Cl. ..... 446/329; 446/370

[58] Field of Search ..... 446/327, 328, 329, 330, 446/337, 338, 339, 352, 353, 359, 304, 313, 26, 363, 369, 370, 371, 319

[56] References Cited

U.S. PATENT DOCUMENTS

| | | | |
|---|---|---|---|
| 683,057 | 10/1901 | Kilpatrick . | |
| 928,744 | 7/1909 | Fisher . | |
| 1,417,860 | 5/1922 | Reich . | |
| 1,432,628 | 10/1922 | Slocum . | |
| 1,518,576 | 12/1924 | Edwards . | |
| 1,644,827 | 10/1927 | Goldenberg | 446/371 |
| 1,782,477 | 11/1930 | Price . | |
| 1,865,305 | 6/1932 | Dallas . | |
| 2,036,328 | 4/1936 | Furey . | |
| 2,158,860 | 5/1939 | Hyde . | |
| 2,241,576 | 5/1941 | Barton . | |
| 2,302,349 | 11/1942 | Renshaw . | |
| 2,614,365 | 10/1952 | Musselwhite et al. . | |
| 2,637,939 | 5/1953 | Polk . | |
| 2,725,670 | 12/1955 | Hodes . | |
| 2,756,448 | 7/1956 | Werbe . | |
| 3,153,871 | 10/1964 | Semba . | |
| 3,358,400 | 12/1967 | Katz et al. . | |
| 3,577,670 | 5/1971 | Gutierrez . | |
| 3,698,127 | 10/1972 | Harp . | |
| 3,828,469 | 9/1974 | Giroud . | |
| 3,918,180 | 11/1975 | Chamberlin . | |
| 3,942,283 | 3/1976 | Rushion . | |
| 4,207,704 | 6/1980 | Akijama . | |
| 4,244,138 | 1/1981 | Holahan et al. . | |
| 4,244,142 | 1/1981 | Crawford | 446/329 X |
| 4,304,065 | 12/1981 | Baiera . | |
| 4,307,533 | 12/1981 | Sims et al. . | |
| 4,324,065 | 4/1982 | Cooper . | |

FOREIGN PATENT DOCUMENTS

| | | | |
|---|---|---|---|
| 337132 | 5/1921 | Fed. Rep. of Germany | 446/327 |

*Primary Examiner*—Mickey Yu

[57] ABSTRACT

A glove puppet assembly, in the form of a spider-like creature, has a tail or abdomen portion which can be articulated by wrist action. It may also have an articulated, finger-operated head component, and utilizes a gripping ring holder and a glove member which facilitate movement of its parts while, in the case of the glove member, also contributing to the aesthetic effect. A plush covering may be provided upon a section of the body member, particularly the tail portion.

19 Claims, 7 Drawing Figures

GLOVE PUPPET FIGURE ASSEMBLY WITH ARTICULATED HEAD COMPONENTS

BACKGROUND OF THE INVENTION

Toys capable of animation have long found widespread appeal among children, and are disclosed in numerous forms in the prior art. One form of such action toys simulates a creature having wings that are movable in a flapping action, as disclosed in the following U.S. Pat. Nos.: 2,036,328 to Furey; 2,637,939 to Polk; 3,153,871 to Semba; 3,577,670 to Gutierrez; 4,244,138 to Holahan et al; and 4,307,533 to Sims et al. Similar toys having parts other than wings that are movable are also disclosed in the art and may, like the winged toys, be animated either manually (e.g., by finger movement, as in hand puppet toys, by pull strings, etc.) or by drive means (e.g., electric or spring-powered motors), as exemplified by the following (all United States) patents:

Fisher describes, in No. 928,744, figure toys having illuminating means for the eyes, mouth and nostrils, and containing a button-operated mechanism for opening the mouth.

A toy in the form of an animal is described by Price in U.S. Pat. No. 1,782,477, wherein a spring-powered motor is provided to produce a walking action as well as movement of head components.

A toy figure having movable parts, animated by a spring motor, is shown in the patent to Hyde, U.S. Pat. No. 2,158,860.

A snake-like toy in the form or a plurality of segments is taught in U.S. Pat. No. 2,241,576 by Barton, wherein strings can be pulled to move the toy in various directions.

In U.S. Pat. No. 2,614,365 Musselwhite et al disclose a doll having arms that are moved by push-button actuation.

Katz et al U.S. Pat. No. 3,358,400 provides a doll having pendulum-controlled eyes moved by a mechanism having cooperating cam and cam follower means.

Harp discloses a puppet in U.S. Pat. No. 3,698,127, which has a movable mouth operated by a pull string.

A head for a doll having lips which are movable to simulate talking is shown in Giroud U.S. Pat. No. 3,828,469; the mechanism used includes a wheel having eccentric studs, which is driven by a motor to impart a reciprocating displacement to the lips.

The patent to Akiyama U.S. Pat. No. 4,207,704, teaches a sound-producing animal-simulating toy, in which a tape recorder can be employed to product voice or other sound sychronized with a movement of the model by any of a variety of means.

A toy game, in the form of a simulated alligator body, is taught in the Cooper U.S. Pat. No. 4,324,065, wherein a leg of the alligator is tied to a latch for operating the upper jaws.

Hand and finger operated puppets or puppet-like toys are disclosed by Kilpatrick in U.S. Pat. No. 683,857; Reich in U.S. Pat. No. 1,417,860; Slocum U.S. Pat. No. 1,432,628; Edwards U.S. Pat. No. 1,518,576; Dallas U.S. Pat. No. 1,865,305; Renshaw U.S. Pat. No. 2,302,349; Werbe U.S. Pat. No. 2,756,448; and Chamberlain U.S. Pat. No. 3,918,180. Hodes U.S. Pat. No. 2,725,670 provides a manipulative animated toy in the form of a mouse in a cage, the mouse being articulated by finger movement. A hand puppet having legs and a head that can be moved by finger manipulation is taught in the patent to Rushton, U.S. Pat. No. 3,942,283. Baiera describes a puppet in the form of a walking or crawling creature, in U.S. Pat. No. 4,304,065; the body consists of a non-functional glove, and appendages into which the fingers of the operator are inserted for manipulation to simulate the walking action.

It is of course desirable to achieve optimal visual appeal, functional effectiveness, and durability in any such toy, while minimizing the complexity of the animating mechanism and the cost of manufacture. Despite the level of prior art activity indicated above, a demand remains for toys of unique construction, in which the foregoing criteria are realized.

Accordingly, a broad object of the present invention is to provide a novel puppet figure having an articulated tail portion attached to a body portion, the tail portion being movable by hand and wrist action while the body is held stationary on the operator's hand.

A more specific object of the invention is to provide such a puppet figure on which an articulated head component is also provided on the body portion, and on which a unique gripping ring holder is employed which not only permits articulation of the tail portion and head component, but also permits movement of the operator's fingers to simulate walking or crawling legs of the puppet figure.

Another object of the invention is to provide a puppet figure having the foregoing features, in combination with a glove member which is constructed to serve both aesthetic and also functional purposes.

Still another object is to provide such a glove puppet figure in which the body member is partially covered by a plush or fur-like material.

SUMMARY OF THE INVENTION

It has now been found that certain of the foregoing and related objects of the invention are attained by the provision of an assembly comprised of a puppet figure including a body portion, a tail portion, and holding means on the body portion adapted to be gripped by the hand of the operator for preventing substantial relative movement thereof. The tail portion is pivotably mounted upon the body portion for articulation about a transverse axis, and the puppet figure is dimensioned and configured to position at least a substantial part of the tail portion beyond the wrist and over the forearm of the operator, when the holding means is grasped. As a result, the tail portion can be pivoted with respect to the body portion by movement of the operator's hand relative to his forearm.

The holding means will advantageously comprise a rigid gripping piece extending from the body portion, and will include a central ring element and flange elements extending outwardly from opposite sides thereof and spaced from the body portion, the flange elements being disposed for gripping by the operator's fingers on either side and outwardly of the ring element. Generally, the assembly will additionally include a glove member having a portion attached to the body portion and adapted to receive the hand of the operator for gripping of the holding means; the attached portion will normally be at the back of the glove member, and attached to the underside of the body portion of the figure. Preferably, the tail portion will have a concave lower wall providing a longitudinally extending recess, for seating it upon the forearm of the operator.

Most desirably, the puppet figure will additionally include a head component pivotably mounted upon the body portion for articulation about a transverse axis spaced to the opposite end thereof from the tail portion, the component typically being a lower jaw piece defining the mouth of the figure. In such a case, the glove member will generally have at least one independently movable finger portion defined therein and operatively connected for articulation of the head component by finger movement. Four additional independently movable finger portions will usually be defined on the glove member, each being constructed to resemble a leg on the body portion; this will permit the operator to simulate walking or crawling of the figure by movement of his fingers within the additional finger portions, while simultaneously articulating the head component with his remaining (normally middle) finger.

Other objects are attained by the provision of a puppet figure including a relatively rigid body member and a sleeve member providing a bulky material partially covering it. At least one component of the body member will be comprised of two interengaged sections, an exterior surface portion of one of the sections being substantially covered by the bulky material and a corresponding exterior surface portion of the other section being substantially uncovered. The sleeve member will have a first area on which the bulky material is present and a second area, of relatively low bulk, free thereof. The member is mounted upon the "one" section, with the "first" area thereof covering the exterior surface portion of the body member and with the "second" area disposed between the sections along the corresponding surface portions, and clamped in place thereby.

Generally, such a sleeve member will be of flexible construction, with the "second" area thereof being made of a relatively lightweight fabric having elastic properties to enhance the tightness of the fit of the sleeve member upon the "one" section. In certain embodiments, the "one" component will be elongated and the sleeve member will be of pocket-like construction, to conform thereto. Preferably, the figure will be a glove puppet assembly in which the glove member defines a plurality of independently movable finger portions; at least certain of the finger portions will have the bulky material on the upper (or back) surfaces thereof, causing them to correspond in appearance to the one section of the body member and to resemble movable legs.

DETAILED DESCRIPTION OF THE ILLUSTRATED EMBODIMENTS

Figure 1:
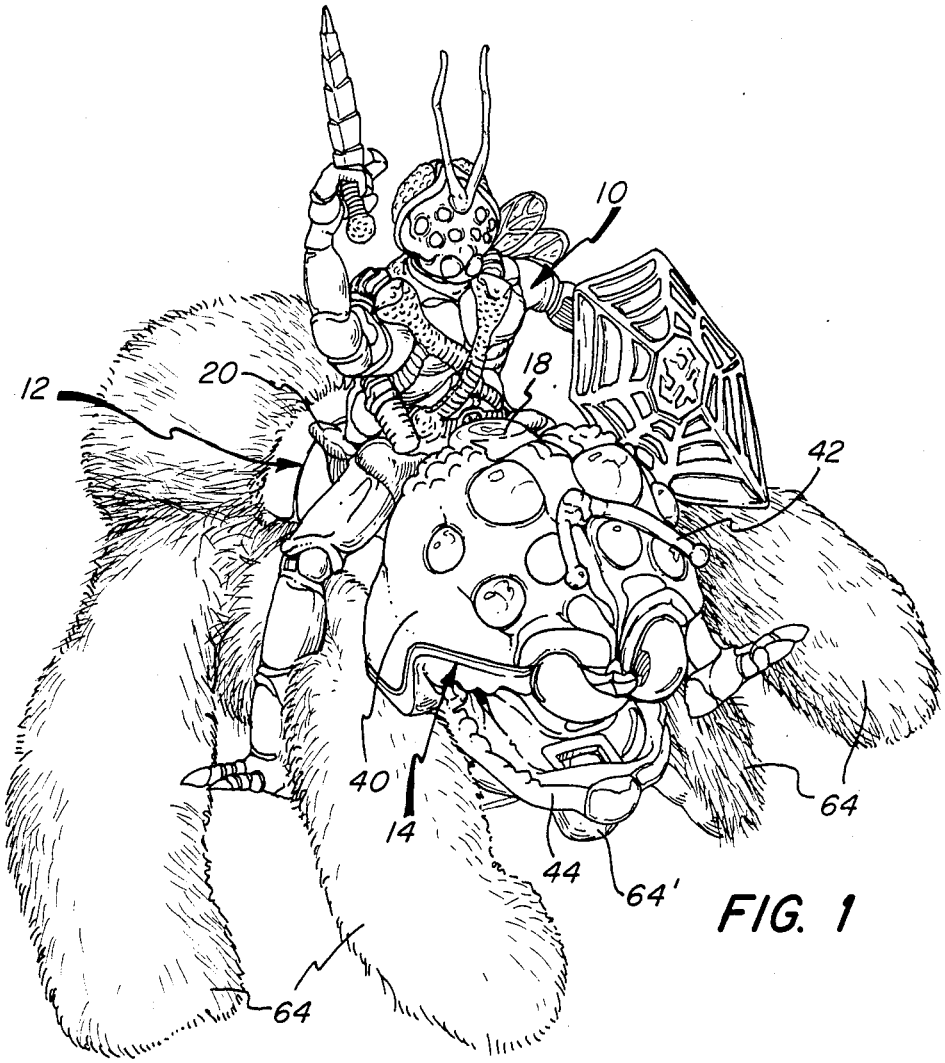
FIG. 1 is a perspective view of a glove puppet figure embodying the present invention, having a humanoid figure seated thereupon.

Although the puppet figure of the invention may take diverse forms, a science-fiction motif is currently regarded to be among the most desirable. Accordingly, FIG. 1 depicts the puppet figure as a fantastic, tarantula-like creature, in combination with a humanoid figure generally designated by the numeral 10; the humanoid figure is included only for the purpose of better illustrating the thematic concept, and itself constitutes no part of the present invention.

Details of construction of the puppet figure are shown in FIGS. 2–7, from which it can be seen to have a segmented body member consisting of a forward body portion and a rearward abdomen or tail portion. The body portion is provided by an upper section, generally designated by the numeral 12, and a lower section generally designated by the numeral 14. At the rearward end of the body portion are provided upstanding cooperating saddle pieces 18, 20, and an underlying gripping ring member generally designated by the numeral 22. The saddle pieces 18, 20 have depending post portions 24 thereon, which pass through the cylindrical bosses 28 in the top wall 30 of the upper body section 12, and are held in place by screws 36. The base portion 38 of the gripping ring member 22 is seated in the recess 16 formed into the bottom wall 34, and is secured in place by an additional screw 36. The two sections 12, 14 may be secured in assembly by any appropriate means, such as by mechanical fasteners, by fusion or adhesive bonding, etc. A head formation 40 is cooperatively provided at the forward end of the body portion by the two sections 12, 14, and for appearance purposes an antenna-like piece 42 is affixed to the head at a suitable location.

Figures 3, 4, 5, 6, 7:
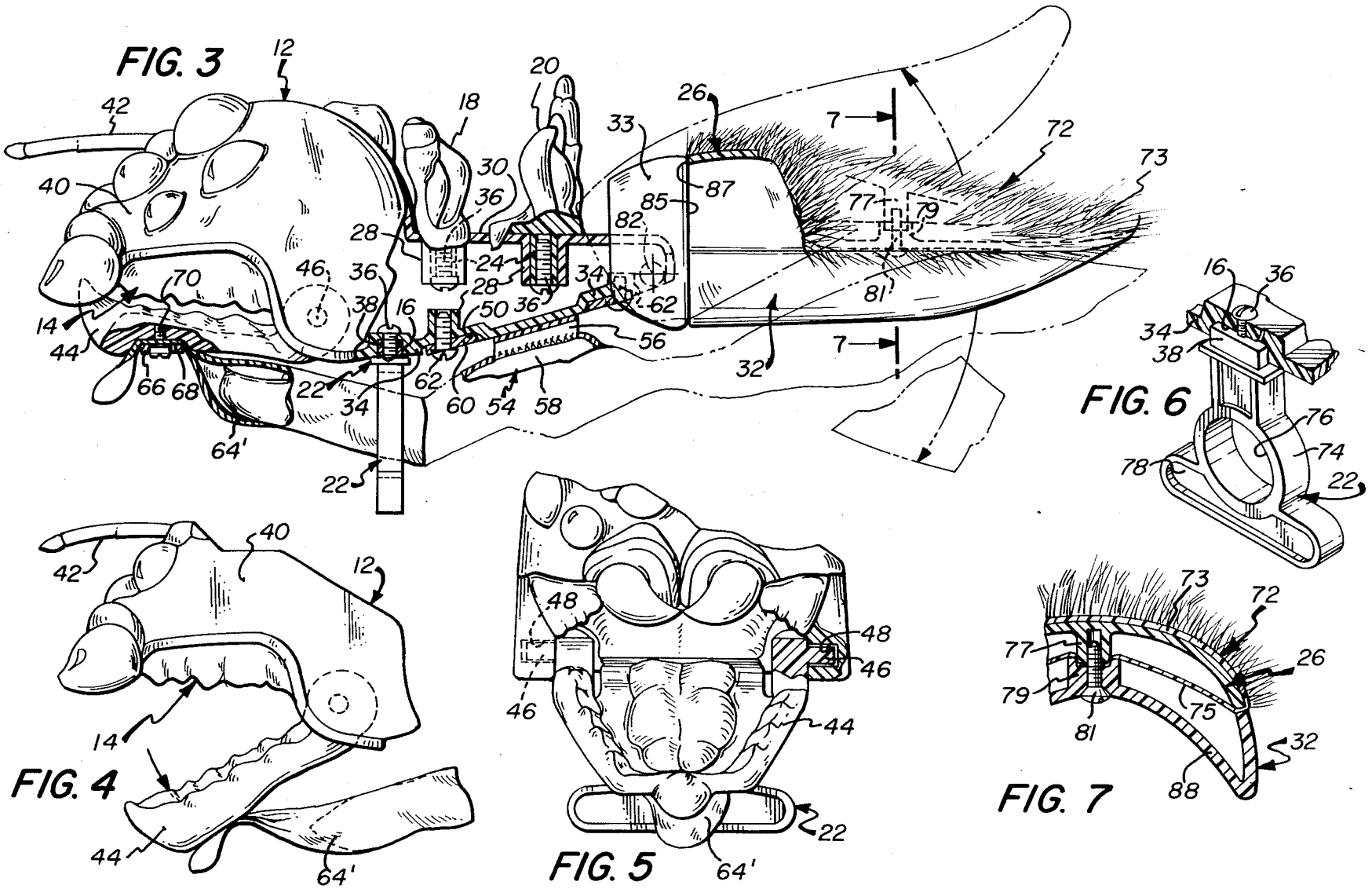
FIG. 3 is a fragmentary elevational view of the puppet figure of FIG. 1, drawn in partial section and to an enlarged scale, and showing in full and phantom line the range of pivoted positions of the tail portion.
FIG. 4 is a fragmentary elevational view of the head of the puppet figure, showing the bottom jaw in its lowered position.
FIG. 5 is a fragmentary front elevational view of the puppet figure with a portion broken away to illustrate the jaw mounting structure.
FIG. 6 is a perspective view of the gripping ring holder used for hand support of the puppet figure, also showing a small section of the body to which the holder is attached.
FIG. 7 is a fragmentary sectional view of the body of the puppet figure, taken along line 7—7 in FIG. 3.

A bottom jaw component 44 is pivotably mounted within the head formation 40, for which purpose stub axle elements 46 project laterally from each side into small circular recesses 48 formed into the interior wall of the lower section 14. As will be appreciated, and as is shown by the representations of FIGS. 3–5, the lower jaw component 44 is freely pivotable to assume an open-mouth position under the force of gravity.

A similarly mounted articulated tail portion is provided at the rear of the body portion, and consists of an upper section and a lower section, generally designated by the numerals 26, 32, respectively. The body portion has outwardly projecting stub axles elements 82 thereon (similar to the elements 46 on the lower jaw 44), which are received in circular recesses (also similar to the recesses 48 for the elements 46) within the semicircular arch portion 33, which is integral with the lower section 32 of the tail portion. In this manner, the tail portion is pivotably mounted upon the body portion for movement between the extreme positions shown in phantom line in FIG. 3.

Figure 2:
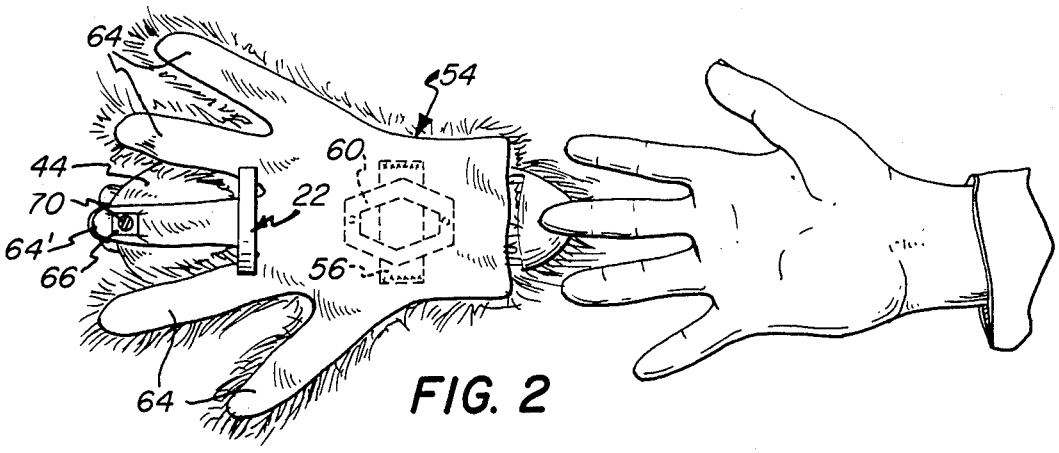
FIG. 2 is a bottom view of the puppet figure of FIG. 1, drawn to a reduced scale and showing the hand of an operator positioned for insertion into the glove member thereof.

Turning now in more detail to FIG. 2, a glove member, generally designated by the numeral 54, is secured to the bottom wall 34 of the lower body section 14 of the puppet figure. It has a band or loop 56 affixed on its back portion 58, which is clamped in place by a substantially hexagonal retainer 60 seated within the correspondingly shaped recess 50 formed into the underside of the wall 34 and affixed therein by screws 62 received within cylindrical bosses 29. The glove member has five finger portions 64, the tip of the middle one 64' being attached to the underside of the jaw component 44 by a small plate 66, which is received within a corresponding recess 68 and held in place by a screw 70. In this manner, the finger of the operator can be used to pivot the jaw upwardly and downwardly about the axle elements 46.

The gripping ring member 22 is constructed both to accommodate the middle finger 64' of the glove member 54 and also to enable the operator hold the body of the puppet figure substantially immobile. As best seen in FIG. 6, the gripping member 22 has a ring portion 74, with an opening 76 through which the finger portion 64' is inserted, at the bottom of which are formed laterally extending ears or flange elements 78. As a result, with his hand inserted into the glove member 54 and his middle finger extended through the ring portion 74, the operator's adjacent fingers can be positioned along the outside of the ring portion 74 and curled over the flange elements 78, thereby enabling him to securely grasp the gripping member.

All of the fingers 64 (other than middle finger 64') of the glove member 54 are constructed to give the appearance of spider-like legs, the back panel 58 being made of a plush or fur-like material for that purpose. As is suggested in FIG. 1, the fingers of the operator can be moved to "walk" the puppet across a surface, or simply to simulate lifelike activity. Because of the unique design of the gripping ring, movement of the legs (as well as of the head component and tail portion) can be achieved while the body of the creature is held in a stable position relative to the hand.

With additional reference now to FIG. 7, it can be seen that a further appearance feature of the puppet figure is provided by the application of a fabric covering piece, in the form of a closed-ended sleeve or pocket, generally designated by the numeral 72. It consists of an outer panel 73, covered by a plush or fur-simulating material like that on glove panel 58, and an inner panel 75 of a relatively lightweight fabric (free of any such bulky material); the inner panel will desirably be made of a fabric having elastic qualities, such as spandex. The two panels will be sewn or otherwise joined to one another about their peripheries, leaving an open end, defined by the edge 87, for insertion of the upper section 26 of the tail portion. In assembly, the fur covered panel 73 will be disposed over the exterior surface, and the lightweight panel 75 will wrap around the peripheral edge of the section 26 and extend thereacross.

The two body sections are secured together by screws 81 which are engaged in cooperating post and column portions 77, 79 at two longitudinally spaced locations (only one of which is shown) on the upper and lower sections, 26, 32, respectively. As a result, the sleeve 72 is clamped between the mating edges of the two sections to hold it firmly in place, with the elasticity of the panel 75 serving to establish an initial close fit about the upper section 12. The edge 87 of the pocket opening abuts against the shallow shoulder 85 of the curved arch portion 33 to contribute to the neat appearance of the assembly.

As can also be seen in FIG. 7, the bottom wall 88 of the lower section 32 is of upwardly arched or concave cross section. This configuration is maintained throughout the length of the tail portion, thereby allowing it to conform generally to the top of the operator's forearm, seating comfortably thereupon and extending downwardly along the sides, as shown.

As will be appreciated, the tail portion is generally articulated by wrist action. When the operator's hand extends straight out from his forearm, the puppet figure will be disposed in the full line position of FIG. 3. Bending the hand upwardly will cause the forearm to pivot the tail portion to a position that is elevated relative to the body portion, whereas downward flexure of the hand will permit the tail portion to assume a drooping attitude; to enable such actuation, it will of course be necessary that, in the normal position of support, the tail portion extend into contact with the operator's forearm. Hand action alone (i.e., movement of the fingers) can also be used to articulate the tail portion, albeit with consequential reduction of the grip upon the holder 22.

Although the plush sleeve 72 is illustrated as a covering over the back of the tail or abdomen portion of the figure, it should be appreciated that it may (by use of similar cooperative clamping action of mating sections) cover the body portion as well. Thus, the body and tail portions are referred to together herein as the "body member", any part or virtually all of which (particularly if the portions are not articulated relative to one another) may include the component covered by the plush area. It will also be appreciated that, although the lower jaw is the only articulated head component illustrated, the entire head formation may be pivotably mounted upon the body portion, and therefore comprise that component of the figure.

Various materials of construction can of course be employed for the several parts of the puppet figure, as will be evident to those skilled in the art, but normally it will be fabricated in large part from suitable plastics. As noted above, the glove member will advantageously be comprised of panels of spandex and the plush material, sewed to one another.

Thus, it can be seen that the present invention provides a novel puppet figure having an articulated tail portion attached to a body portion, the tail portion being movable by hand and wrist action while the body is held stationary on the operator's hand. An articulated head component may also be provided on the body portion, and a unique gripping ring holder may be employed, which not only permits articulation of the tail portion and head component but also permits movement of the operator's fingers to simulate walking or crawling legs. The puppet figure may be assembled with a glove member that is constructed to serve both aesthetic and functional purposes, and the body member of the figure may be partially covered by a plush or fur-like material.

Having thus described the invention, what is claimed is:

1. A puppet figure assembly comprised of:

a puppet figure including a body portion, a separate head component, and a separate tail portion, both of said portions being relatively rigid and substantially hollow, said tail portion being pivotably mounted upon said body portion for articulation about a transverse axis thereof, and said head component being pivotably mounted upon said body portion for articulation about a transverse axis spaced to the opposite end thereof from said tail portion; and rigid holding means on said body portion adapted to be gripped by the hand of the operator for preventing substantial movement thereof relative thereto, said puppet figure being dimensioned and configured to position at least a substantial part of said tail portion beyond the wrist add over the forearm of the operator with said holding means so gripped, whereby said tail portion can be pivoted with respect to said body portion by movement of the operator's hand relative to his forearm, and also to position said head component for movement by the finger of the same hand with said holding means so gripped by the operator.

2. The assembly of claim 1 wherein said tail portion has a concave lower wall providing a longitudinally extending recess for seating of said tail portion upon the forearm of the operator.

3. A puppet figure assembly comprised of:

a puppet figure including a body portion and a tail portion, said tail portion being pivotably mounted upon said body portion for articulation about a transverse axis thereof;

a rigid gripping piece extending from said body portion and having a central ring element and flange elements extending outwardly from opposite sides thereof and spaced from said body portion, said flange elements being disposed for gripping by the operator's fingers on either side and outwardly of said ring element for preventing substantial movement of said body portion relative thereto, said puppet figure being dimensioned and configured to position at least a substantial part of said tail portion beyond the wrist and over the forearm of the operator with said gripping piece so gripped, whereby said tail portion can be pivoted with respect to said body portion by movement of the operator's hand relative to his forearm.

4. The assembly of claim 1 additionally including a glove separate member adapted to receive the hand of the operator, said glove member having a portion attached to said body portion of said puppet figure and said holding means being adapted to be gripped by the hand of the operator inserted into said glove member.

5. The assembly of claim 4 wherein said attached portion is a back portion of said glove member and is attached to the underside of said body portion of said figure.

6. The assembly of claim 1 wherein said one component is a lower jaw defining the mouth of said figure.

7. The assembly of claim 4 wherein said glove member has at least one independently movable finger portion defined therein and operatively connected to said head component, whereby said head component can be articulated by finger actuated movement of said finger portion of said glove member.

8. The assembly of claim 7 wherein said glove member has defined thereon four additional independently movable finger portions, each constructed to resemble a leg on said body portion, so that the operator can simulate walking or crawling of said figure, by movement of his fingers within said additional finger portions, while simultaneously articulating said head component with his remaining finger.

9. A puppet figure assembly comprised of:

a puppet figure including a body portion and a tail portion, said tail portion being pivotably mounted upon said body portion for articulation about a transverse axis thereof;

holding means on said body portion adapted to be gripped by the hand of the operator for preventing substantial movement thereof relative thereto, said puppet figure being dimensioned and configured to position at least a substantial part of said tail portion beyond the wrist and over the forearm of the operator with said holding means so gripped, whereby said tail portion can be pivoted with respect to said body portion by movement of the operator's hand relative to his forearm; and a sleeve member providing a bulky material partially covering said tail portion, said tail portion being relatively rigid and comprised of two interengaged sections, an exterior surface portion of one of said sections being substantially covered by said bulky material and a corresponding exterior surface portion of the other section being substantially uncovered, said sleeve member having a first area on which said bulky material is present and a second area, of relatively low bulk, free thereof, said sleeve member being mounted upon said one tail section with said first area thereof covering said exterior surface portion and with said second area disposed between said tail sections along said corresponding surface portions thereof, and clamped in place thereby.

10. The assembly of claim 9 wherein said tail portion is elongated, wherein said sleeve member is of pocket-like flexible construction, and wherein said second area of said sleeve member is made of a relatively lightweight fabric having elastic properties to enhance the tightness of the fit of said sleeve member upon said one tail section.

11. A glove puppet figure assembly comprised of:

a puppet figure including a body portion, a tail portion, and a head component, said portions and component being relatively rigid, and said tail portion and head component being pivotably mounted adjacent opposite ends of said body portion for articulation about a transverse axes thereof;

a separate glove member adapted to receive the hand of the operator, said glove member having a portion attached to said body portion of said puppet figure, and having at least one independently movable finger portion defined therein and operatively connected to said head component; and rigid holding means on said body portion adapted to be gripped by the hand of the operator for preventing substantial movement thereof relative thereto, said puppet figure being dimensioned and configured to position at least a substantial part of said tail portion beyond the wrist and over the forearm of the operator with said holding means so gripped, whereby said head component can be articulated by finger-actuated movement of said finger portion of said gloove member, and said tail portion can be articulated with respect to said body portion by movement of the operator's hand relative to his forearm, while said body portion is maintained by said holding means substantially stationary on the operator's hand.

12. A puppet figure comprised of a relatively rigid body member and a sleeve member providing a bulky material partially covering said body member, at least one component of said body member being comprised of two interengaged sections, an exterior surface portion of one of said sections being substantially covered by said bulky material, and a corresponding exterior surface portion of the other section being substantially uncovered, said sleeve member having a first area on which said bulky material is present and a second area, of relatively low bulk, free thereof, said sleeve member being mounted upon said one section with said first area thereof covering and being shaped by said exterior surface portion and with said second area disposed between said sections along said corresponding surface portions thereof, and clamped in place thereby.

13. The figure of claim 12 wherein said sleeve member is of flexible construction, and wherein said second area of said sleeve member is made of a relative lightweight fabric having elastic properties to enhance the tightness of the fit of said sleeve member upon said one section.

14. The figure of claim 12 wherein said one component is elongated, and wherein said sleeve member is of pocket-like construction.

15. The figure of claim 12 wherein said figure is a glove puppet assembly additionally including a glove member adapted to receive the hand of the operator and having a portion attached to said body member, said glove member having defined thereon a plurality of independently movable finger portions, at least certain of said finger portions having said bulky material on the upper surfaces thereof causing them to correspond in appearance to said one section of said body member and to resemble legs thereon, so that the operator can simulate walking or crawling of said figure by movement of his fingers within said certain finger portions.

16. The figure of claim 15 wherein said one component is a tail portion, and said body member includes a body portion to which said tail portion is pivotably mounted for articulation about a transverse axis thereof.

17. The figure of claim 16 additionally including a head component pivotably mounted upon said body portion for articulation about a transverse axis spaced to the opposite end thereof from said tail portion, and including means on said body portion for preventing substantial movement thereof relative to the hand of the operator, one of said finger portions of said glove member being attached to said head component for finger-actuated articulation while said body is maintained by said holding means substantially stationary on the operator's hand.

18. The figure of claim 18 wherein said holding means comprises a rigid gripping piece extending from said body portion and adapted to be gripped by the hand of the operator inserted into said glove member, said gripping piece having a central ring element and flange elements extending outwardly from opposite sides thereof and spaced from said body portion, said one finger portion of said glove member extending through said ring element of said gripping piece and said flange elements being disposed for gripping by the operator's fingers on either side and outwardly of said ring element.

19. The figure of claim 18 wherein said one finger portion is for the operator's middle finger.

* * * * *